US010450796B2

(12) United States Patent
Seuberling

(10) Patent No.: US 10,450,796 B2
(45) Date of Patent: Oct. 22, 2019

(54) SLIDING SCREEN DOOR

(71) Applicant: David Seuberling, Cincinnati, OH (US)

(72) Inventor: David Seuberling, Cincinnati, OH (US)

(73) Assignee: Home Improvement Systems, Inc., Cincinnati, OH (US)

( * ) Notice: Subject to any disclaimer, the term of this patent is extended or adjusted under 35 U.S.C. 154(b) by 58 days.

(21) Appl. No.: 15/617,486

(22) Filed: Jun. 8, 2017

(65) Prior Publication Data

US 2018/0355665 A1 Dec. 13, 2018

(51) Int. Cl.
*E06B 9/52* (2006.01)
*E05D 15/06* (2006.01)

(52) U.S. Cl.
CPC ..... *E06B 9/52* (2013.01); *E05D 15/0643* (2013.01); *E05D 15/0656* (2013.01); *E05Y 2900/132* (2013.01)

(58) Field of Classification Search
CPC ..... E06B 9/52; E06B 2009/527; E06B 2009/528; E05D 15/0643; E05D 15/0656; E05D 15/06; E05D 15/0621; E05D 15/0626; E05D 15/0647; E05D 15/0652; E05Y 2900/132; E05Y 2900/136; Y10T 16/35; Y10T 16/354; Y10T 16/356; Y10T 16/376
USPC ..... 160/40, 43, 12, 13, 371, 103, 104, 105, 160/106
See application file for complete search history.

(56) References Cited

U.S. PATENT DOCUMENTS 794,524 A * 7/1905 Lobel ..... E05D 15/0643 16/88
2,293,841 A 8/1942 Long
2,485,296 A * 10/1949 Lescaze ..... E06B 3/4609 16/95 R
2,728,101 A * 12/1955 Cowdroy ..... E05D 15/0643 16/88
2,931,434 A * 4/1960 Steel ..... E05D 15/0669 16/105
2,950,756 A * 8/1960 Moloney ..... E05D 15/0669 16/105
2,962,773 A * 12/1960 Heller ..... E06B 3/4618 16/97
2,970,642 A * 2/1961 Parsons ..... E06B 3/4618 160/40
3,022,129 A * 2/1962 Manson ..... A47B 88/493 312/334.33
3,114,944 A * 12/1963 Horgan, Jr. ..... E06B 3/4609 16/105

(Continued)

FOREIGN PATENT DOCUMENTS

WO 2006089553 8/2006

*Primary Examiner* — Johnnie A. Shablack
(74) *Attorney, Agent, or Firm* — Indiano Law Group, LLC

(57) ABSTRACT

A sliding screen door assembly includes a door panel having an outer frame and a screen portion. A sliding assembly slidably couples an upper portion of the outer frame of the door panel to a portion of a wall adjacent a doorway and the sliding assembly facilitates a horizontal sliding of the door panel relative the doorway between a closed position in which the door panel substantially covers the doorway and an open position in which the door panel is located substantially to a side of the doorway. A first barrier member is located above the sliding assembly and a second barrier member is located below the sliding assembly.

19 Claims, 5 Drawing Sheets

(56) References Cited

U.S. PATENT DOCUMENTS 3,295,587 A * 1/1967 Horgan, Jr. ..... E06B 3/4618 160/91
3,416,183 A * 12/1968 Martin ..... E05D 15/0691 16/105
3,473,286 A 10/1969 Miller
3,801,166 A * 4/1974 York ..... F16C 29/04 312/334.44
3,879,894 A * 4/1975 Anderson ..... E05D 15/06 16/105
3,912,341 A * 10/1975 Stein ..... A47B 88/493 312/331
4,044,504 A * 8/1977 Nakada ..... E06B 3/4609 16/96 R
4,070,076 A * 1/1978 Zwillinger ..... F16C 29/02 312/334.13
4,080,686 A * 3/1978 Hagen ..... E05D 15/0643 16/88
4,126,912 A * 11/1978 Johnson ..... E05D 15/0665 16/105
4,252,382 A * 2/1981 Thomas ..... A47B 88/493 312/334.17
4,359,081 A 11/1982 Brower
4,399,636 A * 8/1983 Blackwell ..... E06B 3/26347 160/91
4,404,771 A 9/1983 Murase et al.
4,437,266 A * 3/1984 Keller ..... E06B 7/231 49/406
4,532,743 A * 8/1985 Miller ..... E05B 65/0841 292/304
4,589,464 A * 5/1986 Coller ..... E06B 9/52 160/91
4,838,332 A * 6/1989 Mlenek ..... E06B 3/9682 160/113
5,115,596 A * 5/1992 Fevold ..... B23Q 16/04 16/105
5,551,501 A * 9/1996 Davis ..... E06B 9/52 160/87
5,659,999 A * 8/1997 Benson ..... E05F 1/16 16/72
5,675,946 A * 10/1997 Verbeek ..... E04B 2/7416 52/205
5,992,956 A * 11/1999 Slivon ..... B25H 3/028 312/334.25
6,056,379 A * 5/2000 Weng ..... A47B 88/493 312/334.11
6,152,549 A * 11/2000 Goto ..... A47B 81/06 312/139.2
6,276,091 B1 * 8/2001 Ridgway ..... E05B 65/0864 49/125
6,336,247 B1 1/2002 Schnoor
6,378,267 B1 * 4/2002 Bass ..... E06B 9/52 160/57
6,497,265 B2 * 12/2002 Davis ..... E06B 9/52 160/87
6,679,392 B1 * 1/2004 Costa ..... A47B 61/003 211/162
6,830,299 B2 * 12/2004 Henriott ..... E05D 15/0643 312/139.2
6,909,610 B2 * 6/2005 Cheng ..... G06F 1/183 312/334.11
6,968,657 B2 * 11/2005 Siudzinski ..... E06B 1/28 160/92
7,024,820 B1 * 4/2006 Dustin ..... E06B 9/52 160/105
7,150,130 B2 * 12/2006 Kobayashi ..... E06B 3/26301 52/210
7,171,099 B2 * 1/2007 Barnes ..... G02B 6/4439 385/135
8,079,179 B2 12/2011 Lemming
8,246,126 B1 * 8/2012 Weber ..... A47B 67/005 312/227
8,402,699 B2 * 3/2013 Henriott ..... E06B 3/46 49/410
8,850,659 B2 10/2014 Ewing
8,887,444 B2 * 11/2014 Kalempa ..... E06B 3/4636 49/409
9,009,918 B2 * 4/2015 Haab ..... E05D 15/0652 16/105
9,115,535 B2 * 8/2015 Blais ..... E06B 9/52
2004/0027039 A1 * 2/2004 Delph ..... A47B 96/00 312/334.25
2004/0040214 A1 3/2004 Bitner, II
2005/0206279 A1 * 9/2005 Lilly ..... A47B 81/062 312/204
2007/0119554 A1 * 5/2007 Guffey ..... E04H 3/16 160/371
2007/0199667 A1 * 8/2007 Jumbeck ..... A47H 99/00 160/274
2008/0210385 A1 * 9/2008 Sawyers ..... E06B 9/54 160/31
2009/0159222 A1 * 6/2009 Moriya ..... E06B 9/52 160/378
2009/0272707 A1 * 11/2009 Layton ..... E06B 3/4654 211/153
2011/0162167 A1 * 7/2011 Blais ..... E06B 9/52 16/91
2011/0272104 A1 * 11/2011 Dimitrakoudis ..... E06B 9/36 160/188
2013/0020920 A1 * 1/2013 Weber ..... A47B 67/005 312/334.1
2013/0180675 A1 * 7/2013 Bates ..... E06B 9/24 160/381
2015/0089875 A1 * 4/2015 Malmrose ..... E06B 3/4627 49/130
2016/0230458 A1 * 8/2016 Lee ..... E06B 9/52
2016/0369547 A1 * 12/2016 Sato ..... E05F 1/16
2019/0023537 A1 * 1/2019 Rasanen ..... E05D 15/0652

* cited by examiner

SLIDING SCREEN DOOR

BACKGROUND

Screened enclosures and openings provide a way to enjoy the fresh air of the outdoors while remaining protected against the elements. These screened enclosures and openings also provide protection from various insects, such as mosquitoes, which can be an annoyance and may carry disease. Many current screen doors are not aesthetically pleasing, are poorly made, have little resistance to swaying, and often do not provide sufficient protection against ingress from insects. Therefore, further technological developments are desirable in this area.

SUMMARY

One embodiment of the present application includes a sliding screen door assembly. Other embodiments include unique sliding screen door apparatuses, systems, and methods. Further embodiments, inventions, forms, objects, features, advantages, aspects, and benefits of the present application are otherwise set forth or become apparent from the description and drawings included herein.

BRIEF DESCRIPTION OF THE DRAWINGS

The description herein makes reference to the accompanying drawings wherein like reference numerals refer to like parts throughout, the several views, and wherein.

DETAILED DESCRIPTION

Figure 1:
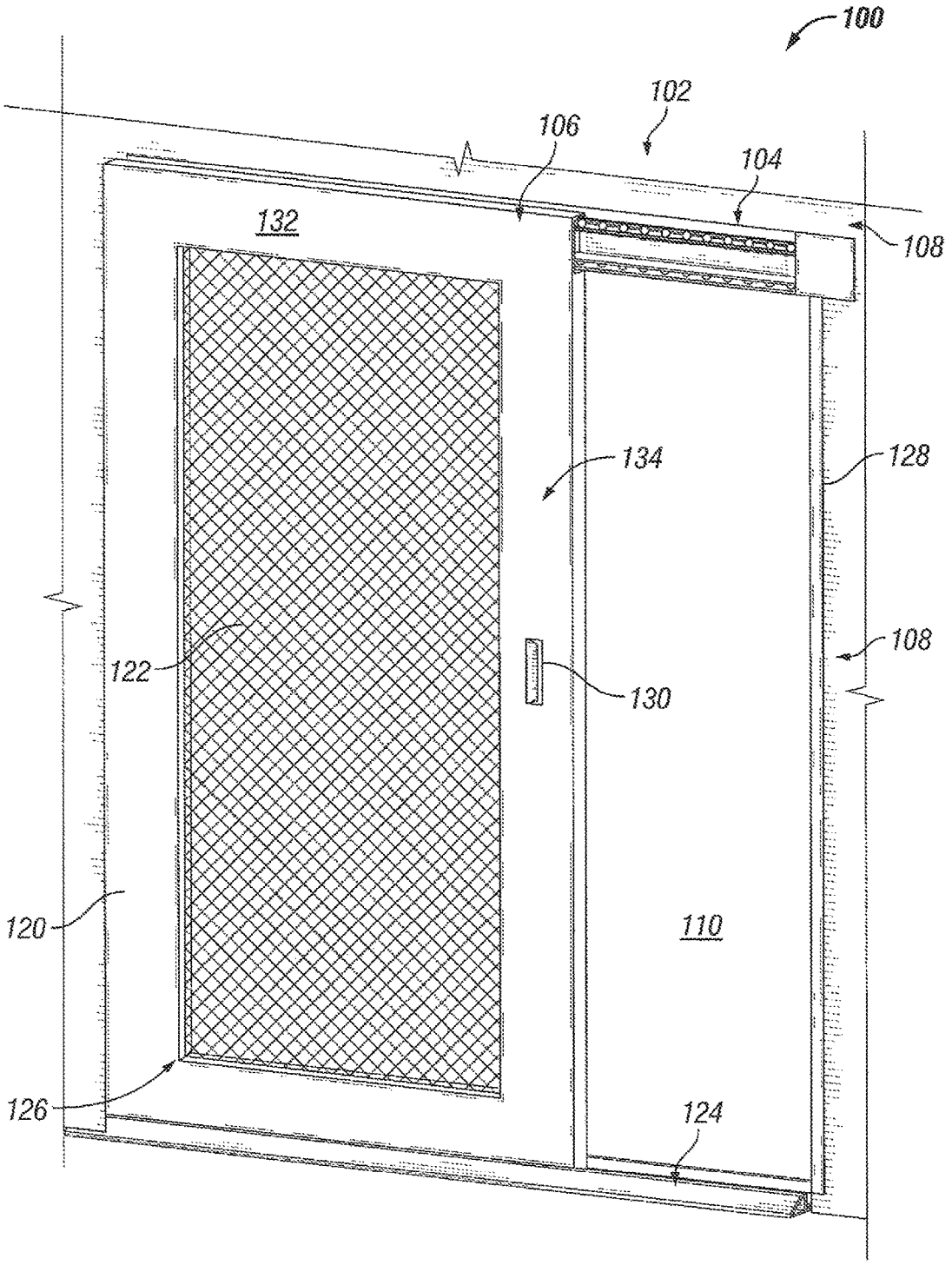
FIG. 1 is a schematic illustration of an embodiment of a sliding screen door assembly of the present application.

For purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

FIG. 1 depicts a sliding screen door assembly 100 of the present application. The screen door 106 includes an outer frame 120 and a screen portion 122. The screen door 106 has an inner face 132 which faces an interior of a room and an exterior face which faces outwardly from the room (e.g. faces outside). As will be discussed in depth hereinafter, a plurality of barrier strips can be located around a perimeter of the door to prevent ingress of insects. The sliding screen door assembly 100 can further include a lower threshold 124 extending across a width of the doorway opening 110.

A sliding assembly 104 permits the screen door 106 to slide across a doorway opening 110. The sliding assembly 104 is attached to an upper portion 102 of the screen door 106 and is further attached to a portion of the wall 108. This sliding assembly 104 vertically supports the weight of the door 106. A user can slide the door, for example through use of door handle 130, from a closed position in which an outer perimeter 134 of opposing sides of the door 106 each cover at least a portion of the wall 108, thereby blocking the doorway 110 to an open position in which the door 106 does not impede ingress or egress of the user through the doorway 110.

Figure 2:
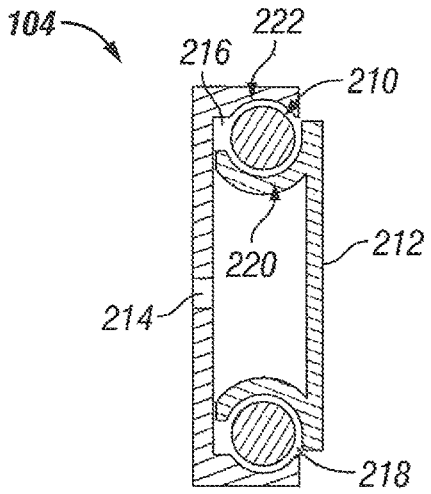
FIG. 2 depicts a cut-away end view of a slide assembly of the present application.

FIG. 2 depicts the sliding assembly 104 of the present application. The sliding assembly 104 permits the screen door 106 to slide relative the wall 108. In one form, the sliding assembly includes a first track portion 212 and a second track portion 214. The first track portion 212 is slidingly engaged with the second track portion 214 such that the first track portion 212 can move horizontally relative the second track portion 214. In a preferred form, the first track portion 212 and the second track portion 214 are placed in sliding engagement via a plurality of ball bearings 210 which are retained in a channel 216. Although ball bearings 210 provide smooth operation and reduce the force required to open and close the screen door 106, it is contemplated that a variety designs, including rollers, bearings, or cooperating channels can be utilized to place the first track portion 212 and the second track portion 212 in sliding engagement. In one form, the first track portion 212 is attached to the upper portion 102 of the door and the second track portion 214 is directly or indirectly attached to a portion of the wall 108.

In addition to providing vertical support to the door 106, the sliding assembly 104 can be configured to resist horizontal motion (e.g. from wind blowing against the outer frame 120 and pushing the door 106 inward relative a door frame). As is illustrated in FIG. 2, legs 220 and 222 of bearing channels 216 and 218 oppose each other in a manner sufficient to resist pivotal motion (e.g. the roller bearings 210 within the channels cooperate with the legs 220, 222 such that the first track portion 212 cannot pivot relative the second track portion 214). Although one specific sliding assembly 104 has been described in detail, it is contemplated that various sliding assemblies 104 can be utilized to provide vertical support to the door 106 and permit the door to slide between an open position and a closed position across the doorway opening 110.

Figure 3A:
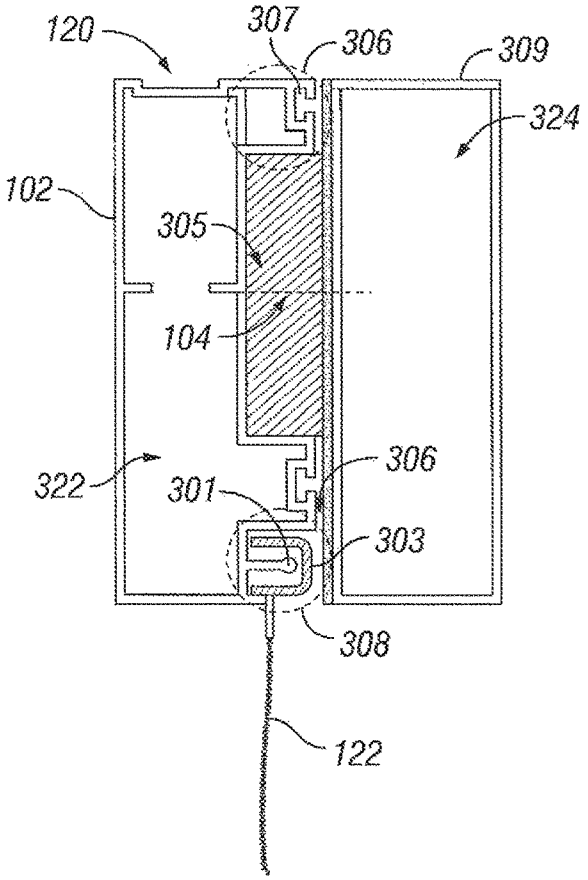
FIGS. 3A and 3B are cut-away views of an extruded sliding screen door assembly depicting a sliding assembly, screen attachment portion, and barrier strips.
Figure 3B:
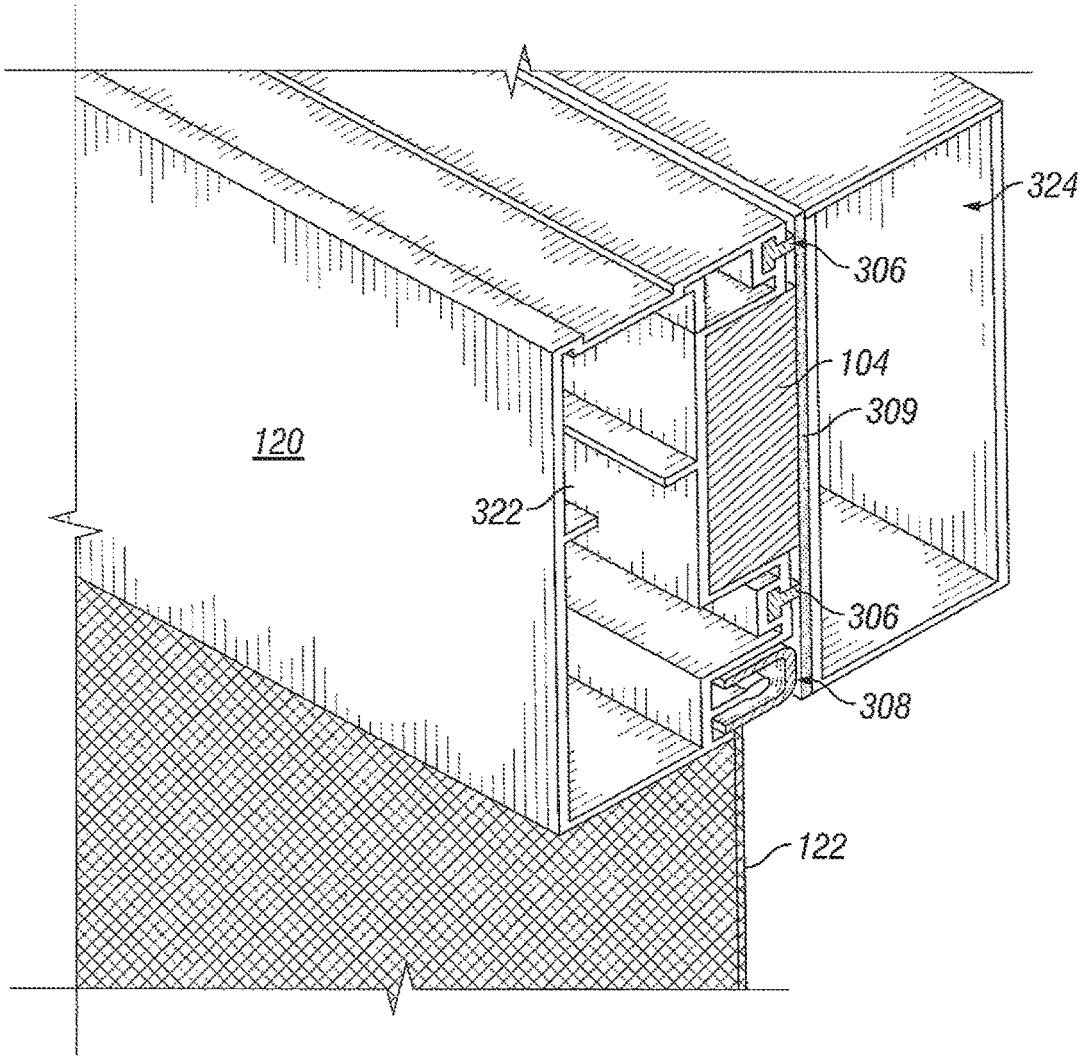

Referring now to FIGS. 3A and 3B, a cut-away view an upper portion of a sliding screen door assembly 100 is depicted. As is illustrated, the sliding screen door assembly 100 includes an outer frame 120, the sliding assembly 104 coupled to the outer frame 120, a barrier strip assembly 306 disposed between the outer frame 120 and a forward frame 309, and a screen retention assembly 308. The upper portion 102 of the outer frame 120 includes a receiving, portion 305 configured to receive the sliding assembly 104 therein. To permit the sliding operation of the screen door 106 across the doorway opening 110, the sliding assembly 104 is connected to the receiving portion 305 and to a wall portion 108. In one form, the first track portion 212 of the sliding assembly is fixedly connected to the receiving portion 305.

A forward flame 309 can be located forward of the sliding assembly 104. The sliding assembly 104 is fixedly connected to the forward frame 309. Utilizing the sliding assembly described in FIG. 2, the second track portion 214 is connected to the forward frame 309. In this form, the sliding assembly 104 permits the sliding screen door 106 to slide relative the forward frame 309. The forward frame 309 is coupled to the wall 108 adjacent the doorway 110. The forward frame 309 can be coupled to a header of the doorway 110 and can span the doorway 110, or in some forms, the forward frame 309 can act as the header depending upon the design parameters of the specific application.

As will be appreciated, the forward frame 309 suspends the sliding screen door 106 outward from the doorway 110 such that the sliding motion of the sliding screen door 106 is unimpeded by the sides of the doorway 110. In this manner, the sliding screen door 106 slides in front of a surface of the wall 108 between a closed position in which the sliding screen door 106 blocks the doorway opening 110 to an open position in which a user may pass through the doorway opening. When the sliding screen door 106 is slid to a closed position, the upper portion 102 of the outer frame 120 can almost completely hide the sliding assembly 104, such that only the outer frame 120 of the sliding screen door 106 is visible from inside the room. This central positioning of the sliding assembly 104 relative the doorway opening 110 can permit the sliding screen door 106 to be slid open to the right or the left of the doorway opening.

However, it is contemplated that the sliding assembly 104 can be fixedly connected to the wall 108 in a variety of locations. For example, the sliding assembly 104 can extend to the left of the doorway. In this form, when the sliding screen door 106 is slid to a closed position across the doorway 110, a significant portion of the sliding assembly 104 may be visible; however, when the sliding screen door 106 is slid to an open position, the outer frame 120 of the sliding screen door 106 can almost completely hide the sliding assembly 104. As would be understood, the sliding assembly 104 can be mounted to the right of the doorway opening 110 such that the sliding screen door 106 will open to the right. Additionally, the sliding assembly 104 could be attached to the wall 108 above the top of the doorway 110. Although specific mounting locations have been discussed, depending upon the requirements of the specific application, it is contemplated that the sliding assembly 104 can be attached to the wall 108 surrounding the doorway 110 in any manner such that the sliding assembly 104 allows the sliding screen door 106 to slide in front of a surface of a wall between a closed position in which the sliding screen door blocks the doorway opening 110 to an open position in which ingress and egress through the doorway opening 110 are permitted.

Figure 5:
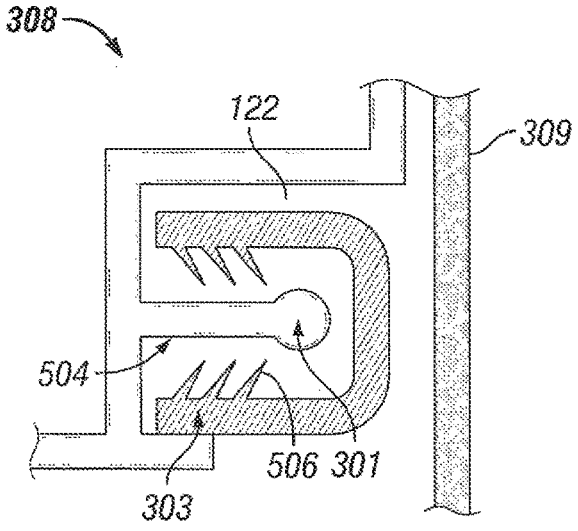
FIG. 5 is an enlarged view of 308 of FIG. 3A depicting a screen installation system.

The outer frame 120 of the screen door 106 includes a screen retention assembly 308 to retain the screen 122 to the outer frame 120. In one form, the screen 122 is replaceably retained to the outer frame 120 through the screen installation system taught in U.S. Pat. No. 6,378,267, which is incorporated herein by reference. Referring to FIG. 5, this screen retention assembly 308 includes a mounting rib 301 projecting from the outer frame 120 of the screen door 106. This mounting rib 301 extends along an inner perimeter of the outer frame 120. The screen 122 is retained to the mounting rib via a trim mold 303 which includes a channel 504 and retention barbs 506 which are configured to mate to the mounting rib 301 and retain the screen 122 therebetween.

Figure 4:
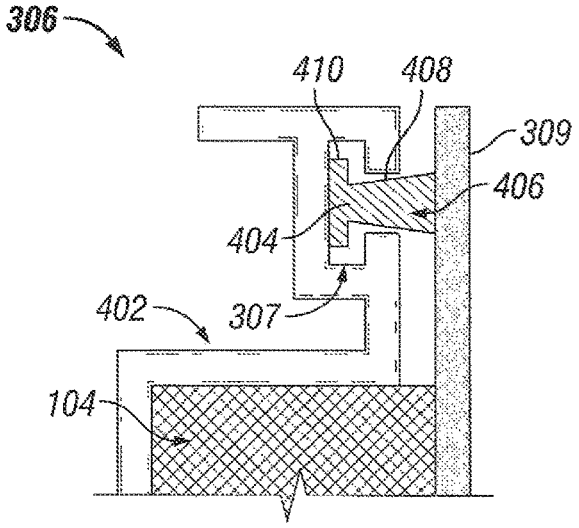
FIG. 4 is an enlarged view of 306 of FIG. 3A depicting a barrier strip and retention channel.

A barrier strip assembly 306 protects against the ingress of insects into the protected enclosure. FIG. 4 depicts an enlarged view of the barrier strip assembly 306. The barrier strip 404 is a semi-flexible member which extends along a width of the sliding screen door 106 and provides an insect resistant seal between the outer frame 120 of the door and the forward frame 309 when the sliding screen door 106 is in a closed position. Although the barrier strip 404 can be constructed of various materials including but not limited to polymers, the barrier strip 404 is depicted as being of a felt construction. A barrier strip retention portion 402 extends outwardly from the outer frame 120 toward the wall 108. The barrier strip retention portion 402 defines a barrier strip receiving channel 307. The barrier strip 404 projects outwardly from the barrier strip receiving channel 307 and extends to an end 406 which presses against the forward frame 309. As will be understood, the width of the barrier strip 404 should be sufficient to traverse the space between the outer frame 120 and the front face 309 or wall 108, depending upon the specific mounting of the sliding screen door 106.

In one form, the barrier strip receiving channel 307 can be formed in a T-shape. In this form, the barrier strip 404 includes outward projections 410 which are received by and retained within the barrier strip receiving channel 307. The barrier strip 404 can include tapered walls 408 which taper outward along a length of the barrier strip 404. This taper can aid in the sealing engagement of the barrier strip 404 within the barrier strip receiving channel 307 and can also aid in the installation of the barrier strip 404 within the barrier strip receiving channel 307. Although a specific barrier strip assembly 306 has been described herein, it is contemplated that the barrier strip 404 assembly can take various forms such that the barrier strip forms an insect resistant seal between the outer frame 120 of the sliding screen door 106 and the forward frame 309 or the wall 108, depending upon the mounting of the sliding screen door 106 thereto, when the sliding screen door 106 is in a closed position.

Referring back to FIGS. 3A and 3B, a first barrier strip assembly 306 is located above the sliding, assembly 104. The sliding screen door assembly 100 can further include a second barrier strip assembly 306 located below the sliding assembly 104. The placement of barrier strip assemblies 306 on opposing sides of the sliding assembly 104 provides resistance against the entrance of insects to an interior of the dwelling. Moreover, barrier strips can additionally be utilized to prevent insect ingress through the sides of the door. For example, as is illustrated in FIG. 1, a barrier strip 128 can be mounted on the wall 108 on opposing sides of the sliding screen door 106. When the sliding screen door 106 is in a closed position, in which the outer perimeter 134 of opposing sides of the door 106 each cover at least a portion of the wall 108, the outer frame 120 will contact the barrier strips 128 on opposing sides thereby providing resistance to insect penetration. Barrier strips 128 can take a form similar to barrier strips 306.

Although it is contemplated that various techniques can be utilized to form the outer frame 120, in one form an extrusion process is utilized. In this manner the mounting rib 301, and where desired the barrier strip receiving channels 307, can be integrally formed with the outer frame 120. Additionally, the use of an extrusion process permits hollow cavities 322 and 324 to be located within the outer frame 120 and upper front frame 309. These hollow cavities 322 and 324 can reduce the amount of material utilized to create the sliding screen door assembly 100 and can reduce the weight thereof.

Figure 7:
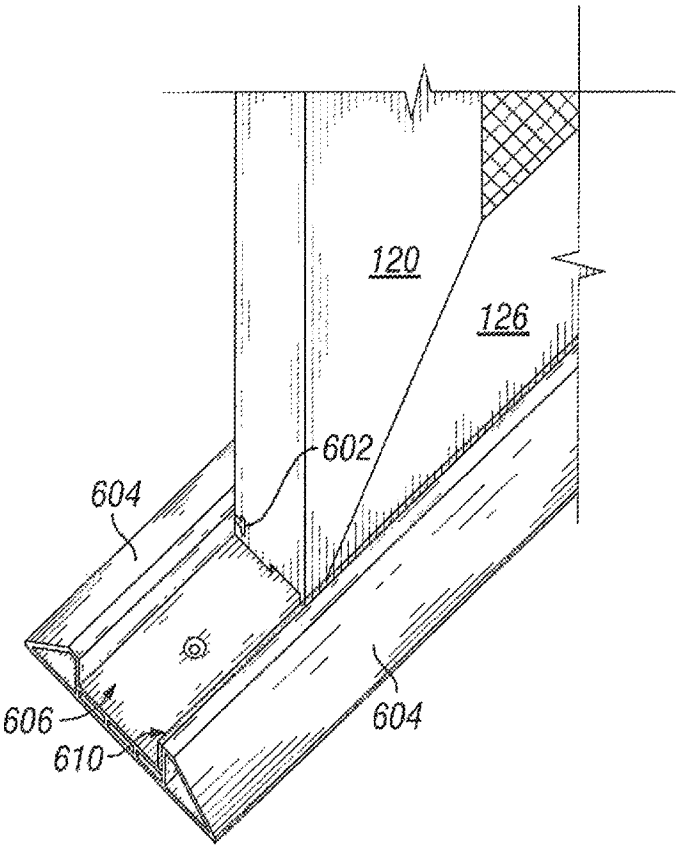
FIG. 7 is a schematic illustration of a lower portion of the sliding screen door assembly of FIG. 1.
Figure 6:
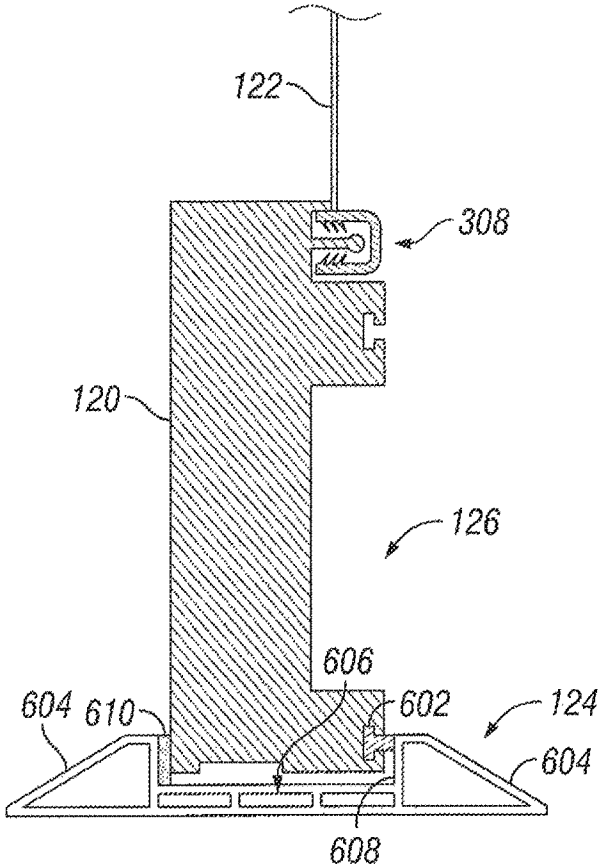
FIG. 6 depicts a cut-away view of a lower portion of the sliding screen door assembly of FIG. 1 including a barrier strip.

Referring now to FIGS. 6 and 7, the sliding screen door assembly 100 can further include a lower threshold 124. This lower threshold 124 is located vertically below the sliding screen door 106, such that a lower portion 126 of the sliding screen door 106 slides in a channel 606 of the lower threshold 124. The lower threshold 124 extends at least along a portion of the doorway opening 110. Opposing walls 608 of the channel 606 resist any forward or rearward movement of the sliding screen door 106. The engagement of the lower portion 126 of the sliding screen door 106 by the channel 606 provides additional resistance to pivotal motion of the sliding screen door 106. As will be appreciated by one of ordinary skill, the pivotal resistance provided by the lower threshold 124 in addition to the pivotal resistance provided by the sliding assembly 104 yields a sliding screen door 106 which is suitable for use in windy climates. Opposing outer sides 604 of the lower threshold 124 are tapered to reduce the risk of tripping on the lower threshold 124 and can enable the structure to remain handicap accessible.

Barrier strips can be integrated with the lower threshold. Barrier strips 602 and 610 are provided to provide an insect resistant barrier between opposing sides of the door and the opposing walls 608 of the channel 606. Although these barrier strips 602, 610 can take various forms sufficient to resist insect penetration through the threshold, barrier strip 602 is depicted having a barrier strip retention channel 307 located in the lower portion 126 of the sliding screen door 106 with barrier strip 404 extending therefrom. The barrier strip 610 is depicted as being a strip of felt 610 extending along a length of the wall 608 of the threshold 124.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there no intention to limit the claim to only one item unless specifically stated to the contrary in the claim. Further, when the language "at least a portion" and/or "a portion" is used the item may include a portion and/or the entire item specifically stated to the contrary.

What is claimed is:

1. A sliding screen door assembly, comprising:

a door panel including an outer frame and a screen portion covering an interior opening defined by the outer frame;

a sliding assembly including a stationary member and a sliding member, wherein the stationary member and the sliding member are placed in sliding communication via a first bearing channel and a second bearing channel, wherein the second bearing channel is located vertically below the first bearing channel, wherein the sliding member is structured to slide horizontally relative the stationary member, wherein the sliding member is operably coupled to an upper portion of the outer frame, and wherein the stationary member is structured to be operatively coupled to a wall structure adjacent an opening;

wherein the sliding assembly provides vertical support for a weight of the door panel and facilitates sliding of the door panel between a closed position and an open position, and wherein the first bearing channel and the second bearing channel of the sliding assembly resist inward pivotal swaying of the door panel;

wherein the upper portion of the outer frame further includes an inner face oriented toward an interior of a room, and wherein the entire inner face is visible from the interior of the room; and a first barrier member, configured to prevent the ingress of insects therethrough, extending outwardly from the outer frame.

2. The sliding screen door assembly of claim 1, further comprising a lower threshold configured to be operably coupled to a floor, wherein the lower threshold includes a channel structured to slidably receive a lower portion of the outer frame therein.

3. The sliding screen door assembly of claim 1, wherein the first barrier member extends outwardly from the outer frame at a location above the sliding assembly, and wherein the outer frame includes a barrier strip receiving channel structured to receive and retain a first end of the first barrier member therein.

4. The sliding screen door assembly of claim 3, further comprising a second barrier member located below the sliding assembly such that the first barrier member and the second barrier member are located adjacent opposing sides of the sliding assembly, wherein the first barrier member and the second barrier member prevent the ingress of insects into the sliding assembly.

5. The sliding screen door assembly of claim 4, wherein a first side of the upper portion of the outer frame further includes a receiving portion defined by the outer frame between the first barrier member and the second barrier member, and wherein the sliding assembly is received by the receiving portion.

6. The sliding screen door assembly of claim 5, further comprising a third barrier member configured to prevent the ingress of insects between the outer frame and the wall structure when the door panel is in the closed position.

7. The sliding screen door assembly of claim 3, further comprising a mounting rib protruding, outwardly from a portion of the outer frame, wherein the screen is retained to the outer frame between the mounting rib and a trim mold configured to be received by and retained upon the mounting rib.

8. The sliding screen door assembly of claim 7, wherein the receiving channel and the mounting rib are integrally extruded with the upper portion of the outer frame.

9. A sliding screen door assembly, comprising:

a door panel having an outer frame defining an interior opening, wherein a screen is retained to the outer frame such that the screen covers the opening;

a sliding assembly configured to slidingly couple an upper portion of the outer frame of the door panel to a portion of a wall adjacent a doorway, wherein the sliding assembly includes a first bearing channel and a second bearing channel located vertically below the first bearing channel, wherein the first bearing channel and the second bearing channel of the sliding assembly facilitate horizontal sliding of the door panel relative the doorway between a closed position in which the door panel substantially covers the doorway and an open position in which the door panel is located substantially to a side of the doorway, and wherein the first bearing channel and the second bearing channel resist pivotal swaying of the door panel;

wherein the sliding assembly is coupled to the upper portion of the outer frame of the door panel in a manner such that the outer frame covers the sliding assembly, thereby hiding the sliding assembly, when the door panel is in the closed position;

wherein the upper portion of the outer frame further includes an inner face oriented toward an interior of a room, and wherein the entire inner face is unobstructed from view from the interior of the room; and a first barrier member configured to cooperate with the outer frame to resist the ingress of insects.

10. The sliding screen door assembly of claim 9, wherein the first barrier member is located on the outer frame above the sliding assembly, and wherein a second barrier member is located below the sliding assembly.

11. The sliding screen door assembly of claim 10, wherein the outer frame includes a first barrier strip receiving channel located above the sliding assembly and a second barrier strip receiving channel located below the sliding assembly, wherein the first barrier strip receiving channel and the second barrier strip receiving channels are configured to receive and retain first ends of the first and second barrier members therein.

12. The sliding screen door assembly of claim 11, further comprising a mounting rib protruding outwardly from a location near an inner perimeter of the outer frame, wherein the screen is retained to the outer frame between the mounting rib and a trim mold configured to lock over the mounting rib.

13. The sliding screen door assembly of claim 12, wherein a first side of the upper portion of the outer frame further includes a receiving portion defined by the outer frame between the first barrier member and the second barrier member, and wherein the sliding assembly is, received by the receiving portion.

14. The sliding screen door assembly of claim 10, further comprising a lower threshold configured to be affixed to a floor, wherein the lower threshold includes a channel configured to slidably receive a lower portion of the outer frame therein.

15. The sliding screen door assembly of claim 14, further comprising a third barrier member configured to cooperate between the lower portion of the outer frame and a wall of the channel of the lower threshold.

16. An apparatus, comprising:

a door panel including an outer frame and a screen configured to cover an interior opening defined by the outer frame;

a horizontal channel extending inwardly from an exterior face of an upper portion of the outer frame, wherein the horizontal channel at least partially extends across a width of an upper portion of the outer frame;

a sliding assembly received by the horizontal channel, wherein the sliding assembly includes a first bearing channel and a second bearing channel located vertically below the first bearing channel, wherein the first bearing channel and the second bearing channel of the sliding assembly facilitate horizontal sliding of the door panel relative the doorway between a closed position in which the door panel substantially covers the doorway and an open position in which the door panel is located substantially to a side of the doorway, wherein the sliding assembly resists pivotal swaying of the door panel, wherein the outer frame covers the sliding assembly when the door panel is in a closed position; and wherein the upper portion of the outer frame further includes an inner face oriented toward an interior of a room, substantially opposite the exterior face, wherein an upward portion of the inner face is unobstructed from view relative the interior of the room;

a first barrier configured to cooperate with the exterior face of the upper portion of the outer frame to resist the ingress of insects.

17. The apparatus of claim 16, further comprising a lower threshold configured to be operably coupled to a floor, wherein the lower threshold includes a channel structured to slidably receive a lower portion of the outer frame therein.

18. The apparatus of claim 16, wherein the first barrier member protrudes from the exterior face of the upper portion of the outer frame, wherein the first barrier member is located above the sliding assembly and a second barrier member is located below the sliding assembly such that the first barrier member and the second barrier member are located adjacent opposing sides of the sliding assembly.

19. The apparatus of claim 18, further comprising a mounting rib protruding outwardly from a location near an inner perimeter of the outer frame, wherein the screen is retained to the outer frame between the mounting rib and a trim mold configured to lock over the mounting rib, and wherein the mounting rib is integrally extruded with outer frame.

* * * * *